United States Patent [19]

Kamegaya et al.

[11] 4,249,105

[45] Feb. 3, 1981

[54] GAS-DISCHARGE DISPLAY PANEL

[75] Inventors: Takeo Kamegaya, Tokyo; Hideomi Matsuzaki, Hatano; Ryuichi Kaneko, Kawasaki; Minori Yokozawa, Sagamihara, all of Japan

[73] Assignee: Nippon Hoso Kyokai, Japan

[21] Appl. No.: 946,334

[22] Filed: Sep. 27, 1978

[30] Foreign Application Priority Data

Oct. 3, 1977 [JP] Japan ..... 52-117901

[51] Int. Cl.[3] ..... H01J 61/067

[52] U.S. Cl. ..... 313/213; 313/346 R; 313/484

[58] Field of Search ..... 313/211, 213, 484, 346 R, 313/336, 351

[56] References Cited

U.S. PATENT DOCUMENTS

| | | | |
|---|---|---|---|
| 2,073,885 | 3/1937 | Spanner et al. | 313/351 X |
| 2,135,707 | 11/1938 | Gaidies | 313/484 |
| 2,426,255 | 8/1947 | Widmaier | 313/351 X |
| 2,639,399 | 5/1953 | Lafferty | 313/345 |
| 3,334,269 | 8/1967 | L'Heureux | 313/220 X |
| 3,630,770 | 12/1971 | Favreau | 313/346 R X |
| 3,743,879 | 7/1973 | Kupsky | 313/484 |
| 3,883,760 | 5/1975 | Cunningham, Jr. | 313/336 X |
| 3,890,609 | 6/1975 | Sasaki et al. | 313/484 X |
| 3,952,221 | 4/1976 | Kamegaya et al. | 313/485 X |
| 4,021,695 | 5/1977 | Kamegaya et al. | 313/484 X |

*Primary Examiner*—Palmer C. Demeo

*Attorney, Agent, or Firm*—Stevens, Davis, Miller & Mosher

[57] ABSTRACT

Disclosed is a gas-discharge display panel having plural discharge cells arranged in a matrix. Each of the discharge cells is provided with a hot cathode consisting of conductive material having a shape which provides a heat capacity and heat conductivity as small as possible. Each cathode is coated by an electron emissive material having a small work function. As a result, the hot cathode can be heated to a required working temperature solely by the bombardment of particles contained in a discharge current itself, without requiring any externally supplied heating power to obtain a highly efficient use of applied driving power.

8 Claims, 14 Drawing Figures

GAS-DISCHARGE DISPLAY PANEL

BACKGROUND OF THE INVENTION (1) Field of the Invention

The present invention relates to a gas-discharge display panel having plural discharge cells arranged in matrix, and especially to an improvement in driving power efficiency therefor.

(2) Description of the Prior Art

Generally speaking, the various kinds of gas-discharge display panels can be classified into two types according to the form of gas-discharge, this is, a direct discharge type wherein discharge electrodes are exposed directly to a discharge space and an indirect discharge type wherein discharge electrodes are screened from the discharge space by coating them with insulation materials, so that discharge electrodes do not affect directly the gas-discharge. The gas-discharge display panel of the present invention belongs to the former type, especially, to the direct discharge type wherein plural discharge cells formed by crossing anodes and cathodes are arranged in a matrix.

The various kinds of conventional methods for displaying a color picture using the above-mentioned type of gas-discharge display panel have many insoluble problems, the most difficult of which is low driving power efficiency.

Ordinarily a discharge cell cathode of a direct discharge type gas-discharge display panel is formed from iron, nickel, or alloys of these metals and others as a wire or plate, and it generally acts as a cold cathode. Accordingly, in a conventional gas-discharge display panel of this type, the igniting voltage and the discharge maintaining voltage are fairly high, and particularly the latter exceeds 200 volts when composite gasses are used to achieve a bright color display by means of exciting a fluorescent layer with ultraviolet rays generated by the gas-discharge.

With respect to the discharging voltages of the discharge cell of the above-mentioned type, the present inventors have proposed to lower those discharging voltages by virtue of the so-called hollow cathode effect caused by the presence of a cylindrical cathode in the discharge cell, and have shown that, as a result thereof, a reduction of discharging voltages and an increase of available discharge current can be obtained. Moreover, the present inventors have also proposed the use of a cathode formed of a planar or cylindrical metal plate which is coated by materials of rare earth elements or alkali earth metals, which materials have a high electron emissivity when bombarded by ions, that is, the so-called $\gamma$ effect, and have shown that a reduction of discharging voltages can be obtained by using this cathode. However, even where these techniques are used, it is difficult to lower the discharge maintaining voltage below 100 volts, and furthermore, the igniting voltage is ordinarily higher than the discharge maintaining voltage by 100 volts or more, so that those voltages remain in a range from 100 volts to 200 volts. A discharge cell requiring such high driving voltages has a low efficiency of energy conversion for luminescence while requiring a high voltage driving power supply.

Generally speaking, the potential distribution along a discharge axis stretched between a cathode and anode in the discharge cell of a gas-discharge display panel is not uniform. Particularly, when a cold cathode is used, most of the driving voltage applied between the cathode and the anode is consumed between the cold cathode and a negative glow appearing in front thereof; this is called the cathode fall voltage. In most of the various kinds of gas-discharge display panels, most of the driving voltage applied between the cathode and the anode, that is, the discharging voltage, is occupied by the cathode fall voltage, which customarily reaches a level from one hundred and several score volts to three hundred volts, so that the most of discharge energy is injected concentrically in a space extending between the cathode and the negative glow. The injected energy is utilized for the electron emission caused by the bombardment of ions against the cathode, and further it is consumed for increasing, accelerating and injecting the emitted electrons into a space occupied by a positive column, as well as consumed mainly as a loss caused by the diffusion of electrons and ions into the cell wall neighbouring the cathode, and as a loss caused by heating gas molecules in a front space of the cathode. These losses of energy are, in general, a fair amount less than the amount of energy which is consumed in the front space of the cathode. Therefore, with respect to the efficiency of energy conversion from the electric power supplied to the discharge cell into ultraviolet rays, visible rays and infrared rays, particularly, into ultraviolet rays, the efficiency of the energy conversion effected in the front space of the cathode is much less than that in the space occupied by the positive column. However, in the front space of the cathode in the discharge cell of the gas-discharge display panel the noted cathode fall inevitably lowers the efficiency of energy conversion which produces a color display as the ultraviolet rays strike the fluorescent layer.

As for the cathode which exists in the discharge cell of the conventional gas-discharge display panel, a metal electrode consisting of nickel, iron or alloys of nickel and cobalt, formed into a plate, a wire or a hollow cylinder, is used, as a so-called cold cathode, from which secondary electrons are emitted by the bombardment of the positive ions in the state of a cold cathode discharge. Accordingly, the discharging voltages reach to 400 volts at the most, so that an extremely low efficiency occurs in the driving power. This low efficiency of driving power induces a rise in the temperature of the gas-discharge display panel, which results in a lowered performance and a shortened panel life caused by impure gasses being released from the discharge electrodes and other materials existing in the discharge cell. Furthermore, the usage of the gas-discharge display panel is restricted for fear that the display panel may be damaged. Moreover, the high discharging voltages restrict ones selection of available circuit elements for forming the driving circuit of the gas-discharge display panel, and impede the integration of the driving circuit, as integrated circuits typically operate with low voltages.

In order to solve the above mentioned problems, the present inventors have attempted to lower the discharging voltages of the discharge cell by means of applying electron emissive materials having a high $\gamma$ effect, that is, a high emissivity of secondary electrons generated by the bombardment of positive ions, to the cathode of a discharge cell. However, no significant solution has yet been obtained.

It is practicable as the second best solution to improving efficiency that a hot cathode discharge be provided in a state of low voltage arc discharge. However, even when a hot cathode is provided by externally supplying a heating current, a large area picture display panel is not practicable for the reasons discussed below.

Glass is customarily used for constructing gas-discharge display panels because of its easiness of processing, its chemical stability and its low manufacturing cost. In the gas-discharge display panel of type just described, the hot cathode of the discharge cell is supplied externally with heating current for emitting electrons. The heating of the cathode may damage the display panel by softening the glass and the life expectancy of the display panel is shortened as impure gasses contained in the glass are released. Accordingly, it is impossible to use a hot cathode heated by the externally supplied heating current in a large area gas-discharge panel.

In order to solve the problems of low energy conversion efficiency, the cathode drop voltage must be reduced, requiring the use of a hot cathode in place of the cold cathode customarily used in conventional gas-discharge display panels. However, it is not practicable to use a hot cathode supplied externally with heating current as in conventional hot cathode tubes for large area display panels. The reasons therefore are as follows.

(1) If a hot cathode supplied externally with the heating power is used in the display panel, the operating temperature increases, and the efficiency of driving power is decreased by the addition of heating power supplied to the cathodes.

(2) The heat resistivity of parts and vessels used for constructing the gas-discharge display panel is not suitable for an externally heated cathode.

(3) The number of cathodes connected in series is increased in proportion to the area of the display panel resulting in an increased voltage drop due to the increased circuit resistance. This causes an irregularity in the ignition in the discharge cells.

(4) When irregularities in ignition occur, the gas-discharge occurs locally at the series connected cathodes, and consequently an erroneous discharge is caused in the display panel.

(5) The above mentioned increase of the number of cathodes connected in series causes a rise in the heating voltage supplied to the cathodes, so that the related circuit becomes more complicated and larger than that in conventional display panels.

(6) When carbonates are applied to the hot cathode as the electron emission material, it is difficult to activate those carbonates to the exclusion of other parts and vessels provided for constructing the display panel.

SUMMARY OF THE INVENTION

An object of the present invention is to overcome the foregoing problems and to provide a gas-discharge color display panel having an excellent driving power efficiency for luminescence.

Another object of the present invention is to lower the driving voltage for a gas-discharge display panel, so as to enable the integration of a suitable driving circuit.

Still another object of the present invention is to reduce the temperature rise in the gas discharge display panel thereby increasing its practical use.

The gas-discharge display panel according to the present invention, wherein plural discharge cells are arranged in matrix, is characterized in that the cathodes of the discharge cells are constructed to have a heat capacity and the heat conductivity as small as possible. The cathodes are also coated with electron emissive materials having a small work function thereby making the cathodes act as hot cathodes by means of bombarding the surfaces thereof with ions generated by the gas-discharge caused in the discharge cells.

In order to overcome the above discussed problems associated with externally heated cathodes, the discharge cell cathodes of the present invention act as self heating hot cathodes which are heated by being bombarded with positive ions generated by the gas-discharge. A fluorescent lamp of the preheat starting type is provided with a hot cathode which is similar to the above mentioned cathode. On the other hand, a fluorescent lamp of the instantaneous starting type is always supplied externally with a heating current. In contrast therewith, the hot cathode fluorescent lamp of the former type is not always supplied with the external heating current, but is only supplied with it at the start. Furthermore, the amount of discharge current consisting of hot electrons emitted by the hot cathode reaches to a range from one hundred and scores milliamperes to several hundreds of milliamperes, and the state of gas-discharge varies between various modes of hot cathode discharge, namely, ball of fire mode, Langmuir mode and temperature limited mode. In contrast therewith, the self heating type hot cathode according to the present invention is characterized in that no heating current is supplied externally to it, and the discharge acts substantially only in the temperature limited mode.

The present inventors have found that the extreme reduction of the discharging voltages can be realized by means of introducing a self heating hot cathode into the gas discharge cell.

The cathode of the conventional discharge cell is formed as a cold cathode consisting of nickel, iron or alloys of nickel and cobalt in a form of narrow tablet or of wire. In contrast therewith, the cathode of the discharge cell according to the present invention consists of a conductive material having a small specific heat, for instance, wolfram or nickel, having a shape which produces a small heat capacity based on a small cross-section for conducting the heat therethrough. The shape may be, for instance, in a form of coil or mesh. The material is coated by an electron emissive material having a small work function of 3.5 eV at the most. The cathode formed as mentioned above acts as a self heating type hot cathode heated by the bombardment of positive ions generated by the gas-discharge, so that the extreme reduction of discharging voltages can be realized.

As for the electron emissive materials used for constructing the above mentioned cathode, for instance, oxides of barium, strontium and calcium can be adopted. As mentioned earlier, it is difficult to use the above mentioned materials in a state of carbonate, since it is required to activate these salts by heat decomposition.

In light of the above discussed problems concerning gas-discharge display panels, it is recommended that the electron emissive material used have the following properties.

(1) Easy electron emission (2) Chemical stability and easy treatment (3) A low temperature of decomposition for isolating an electron emissive material in the activation (4) Chemical stability against base metals used for forming the cathode by means of coating electron emissive materials (5) Excellent strength and resistance against ion bombardment (6) A low vapour pressure required for the inertness against gasses within the gas-discharge display panel.

The present inventors have ascertained that electron emissive materials having the above mentioned properties include, azides of alkali earth metals which are represented by barium azide and borides of alkali earth metals and borides of rare earth elements which are represented by lanthanum boride.

For example, the use of barium azide, that is $Ba(N_3)_2$ will be explained.

The barium azide can be decomposed by means of heating to about 120° C. in a vacuum as follows, so as to produce an isolated barium.

$$4Ba(N_3)_2 \rightarrow Ba_3N_2 + Ba + 11N_2$$

In the process of decomposition, the nitrogen $N_2$ involved in the right side of the above chemical equation is released into the air by the evacuation performed in the process of activation, so as to leave the barium azide $Ba_3N_2$.

It is well known that the above state can be maintained stably regardless of a temperature rise. However, since the nitrogen gas is released little by little by the decomposition of the barium azide, it is required to add a reducing agent consisting of titanium or zirconium to the barium azide, so as to produce the isolated barium, which contributes the electron emission, in such a state that the release of nitrogen gas is prevented by means of generating titanium nitride or zircomium nitride.

DESCRIPTION OF THE PREFERRED EMBODIMENTS

Figure 1A:
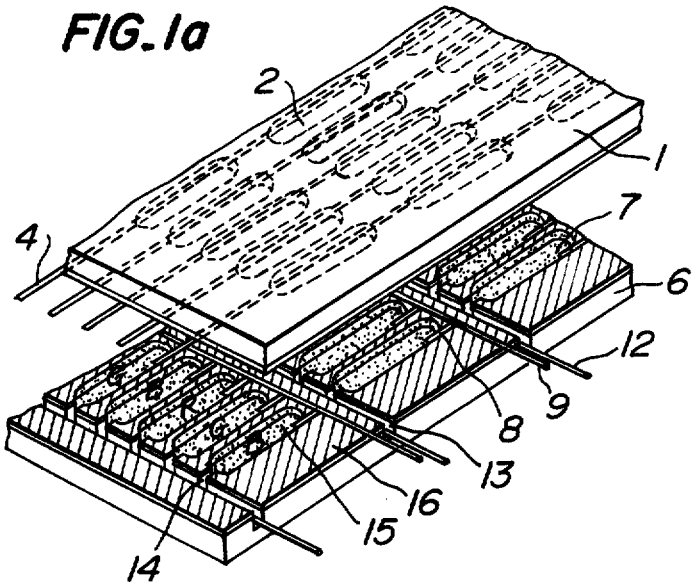
FIGS. 1(*a*), (*b*) and (*c*) respectively show a perspective view, a side view and a plan view of a preferred embodiment of the gas-discharge display panel according to the present invention.

The preferred embodiments of the present invention will be explained by referring to the drawings as follows.

Figure 1B:
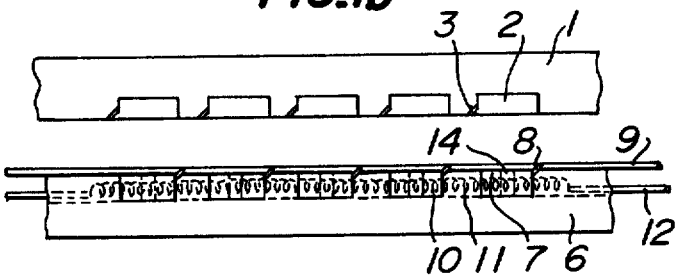
Figure 1C:
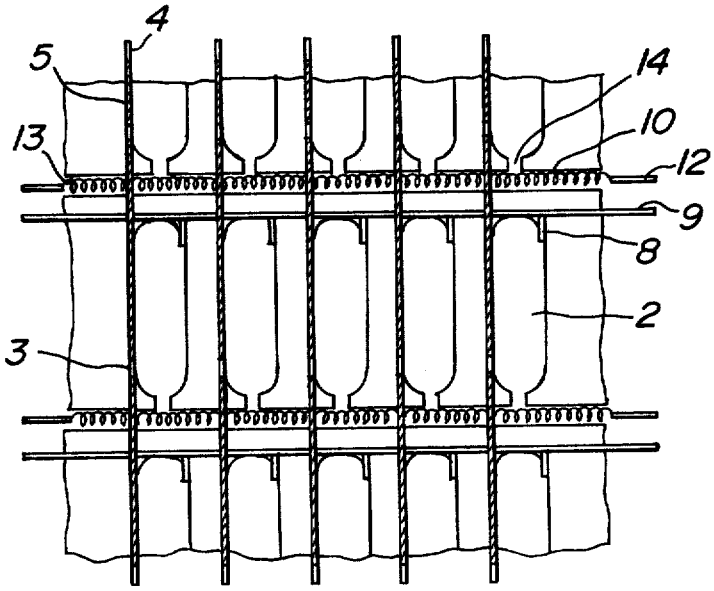

FIGS. 1(*a*) to (*c*) respectively show different views of a preferred embodiment of the gas-discharge display panel according to the present invention.

In the embodiment shown in FIGS. 1(*a*) to (*c*), 1 is a transparent front plate consisting of an electric insulation material, for instance, of glass, 2 is an elongated recess which is arranged in parallel with other like recesses in its longitudinal direction on an inner face of the front plate 1 and which is used for composing a discharge cell, 3 is an auxiliary anode consisting of a conductive film deposited along a longitudinal edge of the recess 2, 4 is an auxiliary anode connecting conductor consisting of a conductive film provided for connecting the auxiliary anodes with one another, 5 is an insulation film consisting of frit glass provided for insulating the auxiliary anode connecting conductor 4, 6 is a rear plate consisting of transparent or opaque insulation material, for instance, glass or ceramic, including photosensitive glass, 7 is another elongated recess which is arranged in parallel with other like recesses in its longitudinal direction on an inner face of the rear plate 6 and which is provided for forming a space of a discharge cell in combination with the recess 2 arranged on the inner face of the front plate 1, 8 is an anode consisting of a conductive film deposited along a longitudinal edge of the recess 7, 9 is an anode connecting conductor consisting of a conductive film provided for connecting one end of the anodes 8 with one another, 10 is a self heating hot cathode formed as a single coil according to the present invention, 11 is an electron emissive material deposited on a surface of the coiled cathode 10, 12 is a lead wire provided for leading out the cathode 10, 13 is an elongated groove extending in a direction crossing the recess 7 which forms the space of the discharge cell provided for accommodating the cathode 10, 14 is a discharge path provided for making the cathode 10 and both the anode 8 and the auxiliary anode 3 interact with one another, 15 is a fluorescent layer deposited on an inner surface of the recess 8 arranged on the inner face of the rear plate 6 for obtaining the luminescence of red (R), green (G) and blue (B) respectively, and 16 is an insulation film consisting of, for instance, frit glass provided for insulating the anode connecting conductor 4. The front plate 1 and the rear plate 6 are stacked together, and the fringes thereof are closed by an adhesive agent in a vacuum tight state, and then rare gasses, for instance, helium, neon, argon, xenon and krypton are filled in an inner space thereof singly or in a state of mixture. The picture display is performed by means of creating plural luminous points in a matrix during panel operation.

In the gas-discharge display panel constructed as described according to the present invention, the self heating hot cathode 10 and the electron emissive layer 11 are the most significant.

Figure 2:
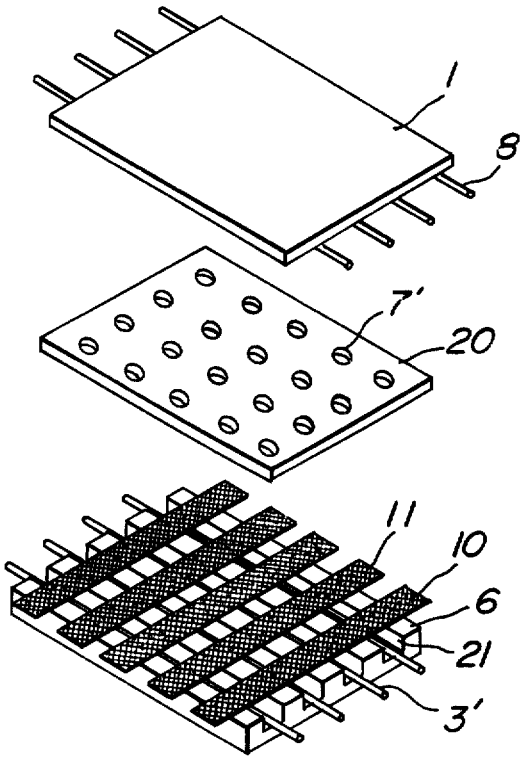
FIG. 2 is a perspective view showing another preferred embodiment of the invention.

FIG. 2 shows another preferred embodiment of the gas-discharge display panel according to the present invention.

In the embodiment shown in FIG. 2, 1 is a front plate, 8 is an anode, 20 is an intermediate sheet wherein plural small hole 7' are arranged in matrix for forming the spaces of the discharge cells respectively, 6 is a rear plate, 10 is a self heating hot cathode consisting of wire mesh formed as a belt according to the present invention, 11 is an electron emissive material deposited on a surface of the belt of wire mesh forming the cathode 10, and 21 is an elongated groove extending in a direction crossing the belt of the cathode 10 and provided for accommodating an auxiliary anode 3'. The front plate 1, the intermediate sheet 20 and the rear plate 6 are stacked in order, and the fringes thereof are closed by an adhesive agent in a vacuum tight state, and then rare gasses are filled in an inner space thereof singly or in a state of mixture in the same way as mentioned above by referring to FIGS. 1(*a*) to (*c*).

Figure 3:
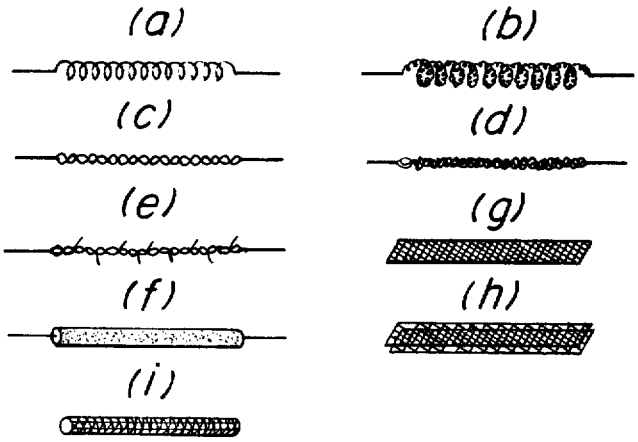
FIGS. 3(*a*) to (*i*) are perspective views showing respectively various embodiments of the cathode used in the gas-discharge display panel according to the present invention.

FIGS. 3(*a*) to (*i*) show various embodiments of the hot cathode used in the gas-discharge display panel according to the present invention respectively. That is, FIG. 3(*a*) shows the cathode formed as a single coil similarly as shown in FIG. 1(*c*), FIG. 3(*b*) shows a cathode formed as a duplicate or multiplicate coil, FIG. 3(*c*) shows a cathode formed as a twisted wire, FIG. 3(*d*) shows a cathode formed as a multiplicate twisted wire, FIG. 3(*e*) shows a cathode formed as a branched twisted wire, FIG. 3(*f*) shows a cathode formed as a porous body, FIG. 3(*g*) shows a cathode formed as a belt of wire mesh similarly as shown in FIG. 2, FIG. 3(*h*) shows a cathode formed as a duplicate belt of wire mesh, and FIG. 3(*i*) shows a cathode formed as a pipe consisting of wire mesh on which an electron emissive material is deposited.

The above embodiments of the cathode consist of nickel or wolfram and an electron emissive material is deposited thereon or impregnated thereinto.

Figure 4:
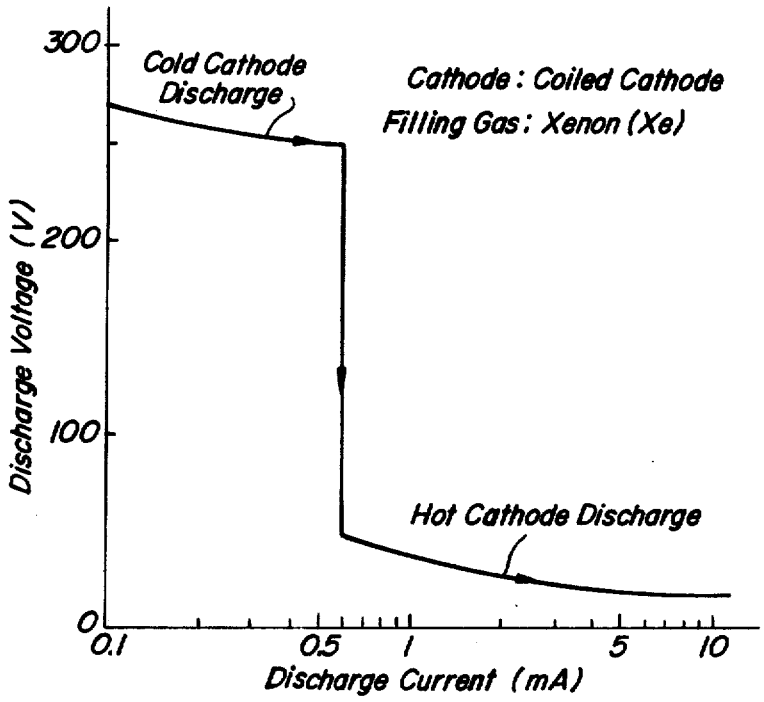
FIG. 4 is a graph showing a preferred discharge voltage to discharge current characteristic curve of the gas-discharge display panel constructed according to the present invention.

FIG. 4 shows an example of the discharge voltage to discharge current characteristic curve representing the relation between the discharge voltage and the discharge current in the discharge cell of a gas-discharge display panel constructed according to the present invention.

The characteristic curve shown in FIG. 4 represents the result of measurements performed with regard to a cathode consisting of the same filament as used in an incandescent lamp having a wattage of 60 W, which is coated with an electron emissive material according to the present invention. In the range almost beyond 0.7 mA of the discharge current shown in FIG. 4, the state of hot cathode discharge can be obtained. In this state, the discharge voltage drops rapidly from two hundreds and scores volts in the state of cold cathode discharge to scores volts, and further drops below twenty volts in the range of a few milliamperes of the discharge current.

The characteristic curve shown in FIG. 2 varies according to the heat capacity of the cathode, so that where the heat capacity is small, the state of hot cathode discharge can be obtained in a further smaller range of the discharge current. In an ordinary filament type cathode which is supplied externally with a heating current, the more the heat capacity is reduced, the more the resistance of the cathode is increased, so that the voltage applied to the cathode varies according to the drop in the operating voltage of the cathode. However, the hot cathode according to the present invention is not supplied externally with the heating current, so that the increase of the resistance of the cathode, which is caused by the temperature rise thereof, is only a little, and any difficulty caused by the increase of the resistance of the cathode can be overcome.

As mentioned earlier, the gas-discharge display panel according to the present invention is characterized in that a self heating hot cathode is provided in the discharge cell, so that the brilliant point generated on the surface of the cathode is maintained by the self heating action of the discharge current. It is preferable to maintain the brilliant point on the cathode surface continuously by keeping the gas-discharge between the cathode and the auxiliary anode during erasure of the gas-discharge for display. As the result, the gas-discharge for display can be started instantaneously in the duration of a picture display.

The power consumed for the auxiliary gas-discharge should be kept as small as possible. For this reason, the brilliant point on the cathode is maintained continuously preferably by means of applying to the discharge cell a driving pulsive voltage which is arranged to make the heat capacity of the cathode and the heating thereof by the bombardment of positive ions fit for each other. Furthermore, for the same reason also the respective cathodes of plural discharge cells are driven in common by the same driving voltage. On the other hand, it is preferable for modulating the brightness of the gas-discharge display for the purpose of displaying a television picture on the gas-discharge display panel to use a so-called pulse width modulation, whereby the time duration of the continuity of the gas-discharge for display is varied according to the picture signal.

The brightness which can be obtained by a discharge cell provided with the self heating hot cathode of the invention is almost the same as that which can be obtained be a discharge cell provided with the conventional cold cathode wherein a negative glow and the positive column are utilized. Accordingly, the efficiency of energy consumed for effecting luminescence can be greatly increased according to the present invention.

As discussed above, a gas-discharge display panel according to the present invention enables the discharge voltage to be lowered to the range from one fifth to one tenth of that in a conventional display panel while achieving the same brightness obtained in the conventional display panel. Thus, the present invention significantly improves the efficiency of energy consumed for effecting luminescence. The effect of this advantage is particularly useful in the type of gas-discharge color display panel wherein ultraviolet rays generated by the gas-discharge cooperate with the fluorescent layer to provide a light emission. In this type of the display panel, the efficiency of energy is such that the energy required reaches to one tenth of that required in a conventional display panel.

Moreover, the easiness of composition of the driving circuit and the miniaturization based on the integration of the circuit can be realized easily by virtue of the decreased operating voltage of the discharge cell.

Furthermore, in the gas-discharge display panel according to the present invention, since the gas-discharge is performed in the state of hot cathode discharge, the cathode fall voltage is reduced and the voltage consumption based on scattering of the materials forming the cathode is mitigated. Thus, the life of the display panel can be greatly increased. The configuration of the panel apparatus is not at all complicated by the use of the self heating hot cathode, so there is no projected difficulty with mass production. Consequently, a gas-discharge display panel having an extremely long life and remarkably reduced power consumption can be realized in accordance with the present invention.

What is claimed is:

1. A gas discharge display panel comprising a front wall, a rear wall fluid sealed to said front wall, at least one of said front and rear walls being transparent, a plurality of gas-discharge cells arranged in a matrix between said front and rear walls, each of said cells including at least a pair of electrodes consisting of an anode and a self heating cathode which are spaced from one another by a gas-discharge path, and a gas filling said discharge cells, said gas including components selected from the group consisting of xenon, krypton and argon, said cathode having a small heat capacity and small heat conductivity and comprising an elongated wiry metal formed as one of a coil, a twisted wire and a wire mesh and having a surface coated with an electron emission material selected from a group of an azide of an alkali earth metal, a boride of an alkali earth metal and a boride of a rare earth metal which belongs to a group of lanthanum and having a work function less than 3.5 electron volts, said cathode being self heated by bombardment of ions generated from a discharge current which is less than a few milliamperes by a gas discharge across said anode and cathode.

2. A gas-discharge display panel as claimed in claim 1, wherein said cathode is formed as a single coil.

3. A gas-discharge display panel as claimed in claim 1, wherein said cathode is formed as a multiplicate coil.

4. A gas-discharge display panel as claimed in claim 1, wherein said cathode is formed as a single twisted wire.

5. A gas-discharge display panel as claimed in claim 1, wherein cathode is formed as a multiplicate twisted wire.

6. A gas-discharge display panel as claimed in claim 1, wherein said cathode is formed as a branched twisted wire.

7. A gas-discharge display panel as claimed in claim 1, wherein said cathode is formed as a belt of wire mesh.

8. A gas-discharge display panel as claimed in claim 1, wherein said cathode is formed as a multiplicate belt of wire mesh.

* * * * *